US005129746A

United States Patent [19]

Epstein

[11] Patent Number: 5,129,746

[45] Date of Patent: Jul. 14, 1992

[54] RECIPROCATING PRINTER SHUTTLE

[76] Inventor: Saul Epstein, 14558 Deervale Pl., Sherman Oaks, Calif. 91403

[21] Appl. No.: 559,714

[22] Filed: Jul. 30, 1990

[51] Int. Cl.[5] ..... B41J 19/14

[52] U.S. Cl. ..... 400/323; 101/93.04

[58] Field of Search ..... 400/320, 322, 323, 341; 101/93.04

[56] References Cited

U.S. PATENT DOCUMENTS

| | | | |
|---|---|---|---|
| 4,084,681 | 4/1978 | Heinzl et al. | 400/320 |
| 4,239,403 | 12/1980 | Matula et al. | 400/322 |
| 4,543,884 | 10/1985 | Kikuchi et al. | 101/93.04 |

FOREIGN PATENT DOCUMENTS

| | | | |
|---|---|---|---|
| 154063 | 11/1981 | Japan | 400/323 |
| 15170 | 1/1985 | Japan | 400/323 |
| 154361 | 6/1988 | Japan | 400/323 |

OTHER PUBLICATIONS

D. E. Cutshall et al; "Los Cost Thermal Printer"; *IBM Technical Disclosure Bulletin;* vol. 21, No. 1, pp. 284–285; Jun. 1978.

*Primary Examiner*—David A. Wiecking

[57] ABSTRACT

A reciprocating printer shuttle which includes a printhead constrained to move with a linear motion and driven by a drive link attached to a belt which runs continuously in one direction around two spaced pulleys. The printhead motion is parallel to the run of the belt between the two pulleys. Printhead motion reverses each time the point of attachemnt of the drive link passes around one of the pulleys. A counterbalance which has the same mass as the printhead, and is constrained to move parallel to it, is also driven by a drive link attached to the belt. The counterbalance drive link is attached halfway around the belt from the printhead; the counterbalance's decelerations and accelerations at each end of the reciprocating motion are, therefore, exactly opposite to those of the printhead.

6 Claims, 1 Drawing Sheet

RECIPROCATING PRINTER SHUTTLE

BACKGROUND OF THE INVENTION

In a previously filed U.S. patent application, Ser. No. 338,330, a facsimile receiver was described which uses a "drop on demand" type of ink jet printhead. This facsimile receiver prints images on plain paper. Printing on plain paper has obvious advantages over printing on thermal paper (which is the most common type of paper used in facsimile receivers), and the use of an ink jet type of printhead permits a receiver to be made at low cost. In order to keep up with the rate at which facsimile signals are normally received, the printhead cartridge must scan across the page at a relatively high speed, and must be reversed at the end of its travel with very little wasted time. These requirements create serious difficulties for prior art types of shuttle mechanisms.

Prior art types of printer shuttles are normally driven by either stepper motors or DC servo motors. At the end of each scan of the printhead, the motor is stopped and reversed to cause the printhead to scan across the page in the opposite direction. Such designs are satisfactory for applications where the moving masses are small and/or the turnaround accelerations required are low. However, as either the moving mass of the printhead assembly or the turnaround acceleration increases, the motor power required increases. Higher powered motors are, of course, physically larger and more expensive.

There are many applications where motor cost and size are important, yet the moving mass and/or low turnaround accelerations are high, as, for example, in a facsimile receiver using a drop on demand ink jet printhead. In such a receiver, the printhead assembly may weigh four ounces or more, and turnaround accelerations of the order of ten g may be required. These factors may result in a requirement for a larger motor than is desired in such a product. In addition, the inertial forces which result from reversing the printhead motion tend to cause undesirable movements of the printer itself.

SUMMARY OF THE INVENTION

The problems associated with prior art printhead shuttle mechanisms as described above have been substantially reduced in the present invention by utilizing a drive which conserves the momentum of the moving assembly on reversal so that no motor power is required to stop the shuttle and reverse it. In addition, the system is counterbalanced so that there is very little net inertial force coupled to the shuttle mountings. An inexpensive unidirectional constant speed and constantly running motor is used; the power of this motor need only be sufficient to overcome the friction present in the mechanism.

The presently preferred embodiment of the invented shuttle mechanism uses a conventional printhead carriage, including guide rails to position the printhead over the paper and to constrain the printhead to move linearly across it. Motion is imparted to the printhead by a pivoting link which couples the printhead to an endless belt running between two pulleys. One pulley is driven by a motor, and the other is an idler. The belt runs parallel to the direction of travel of the printhead and is located symmetrically with respect to the point of attachment of the pivoting link to the printhead. As the point on the belt which is coupled to the link passes around one of the pulleys, the printhead stops and reverses direction with an approximately sinusoidal deceleration/acceleration motion. When the printhead decelerates during the first quarter revolution of the pulley after the link/belt connection arrives at the pulley, the printhead's kinetic energy, instead of being dissipated as heat, is transferred to the pulleys as rotational energy. This energy is recovered by the printhead during the next quarter revolution of the pulley as the printhead accelerates in the opposite direction. The net amount of energy required to reverse the printhead motion is, therefore, zero. The only power required is that needed to compensate for frictional loss in the system.

Since relatively high turnaround accelerations may be encountered in practical shuttles, provision is made for counterbalancing. A counterbalance having the same moving mass as the printhead runs on a guide which is parallel to the direction of travel of the printhead. The counterbalance is also coupled to the belt by a pivoted link. This link is coupled to the belt exactly opposite to the printhead. Hence, when the printhead is decelerating at one side of the shuttle, the counterbalance is decelerating in the opposite direction at the opposite side of the shuttle. The inertial forces generated by the counterbalance are opposite those generated by the printhead, and hence there is no net external force on the shuttle system which would tend to cause it to move.

As shown in the drawings, the center of mass of the printhead assembly in the direction of its motion does not exactly coincide with the center of mass of the counterbalance. This results in a small inertial couple which will tend to rotate the shuttle mechanism as the printhead reverses. Under normal circumstances, this couple is expected to be too small to be of concern, and hence the presently preferred embodiment of the invention is drawn as it is. If it were found to be necessary or desirable, however, it is possible to locate the center of mass of the printhead assembly so that it does coincide with that of the counterbalance. This can be accomplished, for example, by adding "ears" to the printhead cradle which extend over and under the counterbalance. With such ears (having the appropriate dimensions and mass) the center of mass of the printhead assembly will be moved rearward to coincide with that of the counterbalance. There will then be neither a net force nor couple when the printhead reverses.

DETAILED DESCRIPTION OF THE INVENTION

Figure 1:
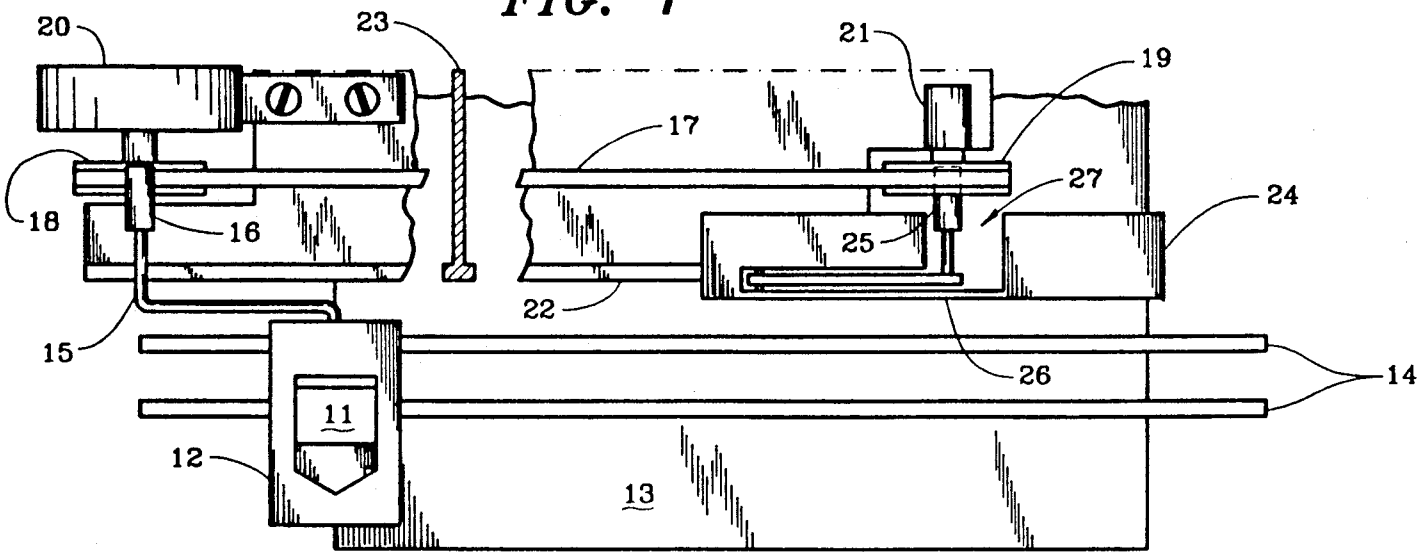
FIG. 1 is a top view of a printhead shuttle according to the present invention.
Figure 2:
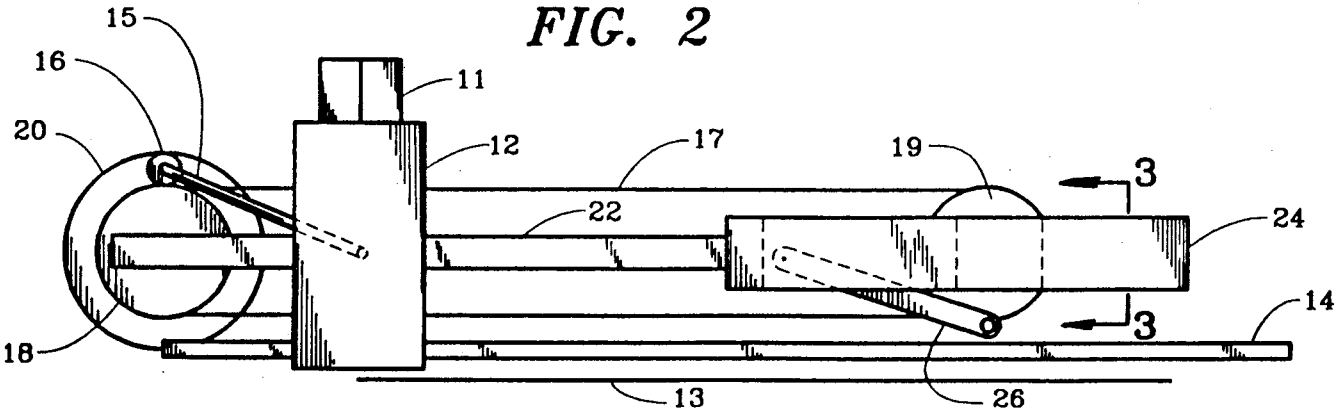
FIG. 2 is a front view of the shuttle of FIG. 1.
Figure 3:
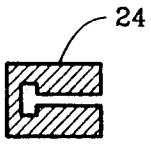
FIG. 3 is a cross sectional view of the counterbalance taken at 3—3 of FIG. 2.

An ink jet cartridge 11 is seen in the drawings being carried in a cradle 12. For clarity, no electrical connections are shown to connect the cartridge to the electrical circuitry. It is known to those in the art, however, that ribbon type cables are most commonly used for such connections; but other types of cable can also be used. The printhead is shown in FIG. 2 positioned over one edge of a sheet of paper 13. A pair of guide rails 14 guide the printhead cradle and keep the printhead spaced the proper distance from the paper as the printhead scans back and forth. The paper is supported on a platen, nor shown. Also not shown are means for advancing the paper after each scan of the printhead. These elements may be of conventional design and are well known to printer designers.

Motion is imparted to the printhead by a link 15 which pivots in the cradle 12 and in bushing 16. The bushing 16 is securely attached to belt 17 which runs around pulleys 18 and 19. Pulley 18 is driven by motor 20 and pulley 19 is an idler, running in bearing 21. Belt 17 can be a steel ribbon, or it can be of other construction, for example, a toothed rubberized fabric belt. Both the motor 20 and idler bearing 21 are fastened to fixed structural members of the printer. For illustrative purposes, they are shown in the drawings attached to counterbalance guide rail 22 which is, in turn, attached to a base member of the printer. Motor 20 is a unidirectional constant speed, constantly running motor of any conventional design. Either an AC or a DC motor may be used as convenient.

If it is assumed that the pulley 18 as seen in FIG. 2 is turning counterclockwise, the system is seen at the moment that the printhead has finished a scan across the page (right to left) and is about to stop and reverse direction. During the first quarter turn of pulley 18 after the position shown in FIG. 2, the printhead will come to a stop with a motion which is nearly sinusoidal. Since momentum must be conserved, when the printhead assembly decelerates, its kinetic energy is transferred to the rotating pulleys 18 and 19, tending to make them rotate faster. During the next quarter turn of the pulleys, the printhead accelerates to its previous speed (but in the opposite direction) absorbing energy from the rotating pulley masses. The amount of energy required to accelerate the printhead is equal to the amount of energy given up by the printhead to the pulleys during the deceleration, and hence, the pulleys slow down by just the amount they speeded up during the previous quarter turn. The printhead then scans across the page as the point on belt 17 where bushing 16 is fastened travels toward pulley 19. When bushing 16 arrives at pulley 19, the printhead assembly again stops and reverses direction as described above.

It will be appreciated that, neglecting friction, no power is needed keep the printhead scanning across the page. Unfortunately, no system is devoid of friction, and some power is needed to make up for frictional losses. Power is also needed to accelerate the system from rest at startup. The power required to overcome friction, and to accelerate the system to operating speed in a reasonable time at startup, are relatively small as compared to the power which would be needed to rapidly reverse the printhead in a system where the momentum is not conserved. Therefore, a much smaller motor can be used with the invented system.

Depending on the particular application involved, unbalanced inertial forces generated by stopping and reversing the printhead may create undesirable effects. In such a case, the mechanism as described above should be counterbalanced. The counterbalance of the present invention is guided by a counterbalance guide rail 22 which is fastened to the base member of the printer by means not shown. The counterbalance guide rail is positioned parallel to the printhead guide rails 14 and has a "T" shaped end (which can be seen in the broken turned section 23 of the guide rail). The counterbalance 24 has a mating "T" slot which is made so that the counterbalance can slide freely along the rail. As can be seen in the drawings, the counterbalance guide rail 22 extends inside the loop formed by belt 17. The counterbalance 24 is coupled to bushing 25 by a pivoting link 26. The bushing 25 is fastened to the belt 17 in the same manner as is bushing 16. The bushing 25 is fastened exactly halfway around the belt from bushing 16. In other words, the location of bushing 25 with respect to pulley 19 is exactly the same as the location of bushing 16 with respect to pulley 18. Hence, the motion of counterbalance 24 is opposite that of the printhead. If the printhead is accelerating, so is the counterbalance. If the printhead is decelerating, so is the counterbalance. The accelerations and decelerations of the printhead and the counterbalance are of the same amounts, but are in opposite directions. The counterbalance is made to have the same mass as the printhead, and therefore any inertial force generated by acceleration or deceleration of the printhead is counterbalanced by an equal and opposite inertial force generated by the counterbalance.

The counterbalance 24 has a cutout portion indicated generally by the numeral 27 which allows the link 26 to pass through as the bushing 25 moves around the pulleys. The placement of the guide rails and the design of the printhead cradle and counterbalance are such that there is no interference between the various parts as they slide past each other during the operation of the shuttle.

What has been described is a novel printhead shuttle which can use an inexpensive low power constant speed motor to drive the mechanism. What is novel and desired to be protected by Letters Patent is defined in the appended claims; the various modifications and adaptations of the invention which will no doubt be made by those skilled in the art are intended to be covered thereby.

I claim:

1. A reciprocating printhead shuttle which comprises:

a printhead;

printhead guide means which constrains said printhead to move linearly;

a pair of spaced pulleys;

an endless belt running around said pulleys;

means for imparting continuous unidirectional motion to said belt;

means fastened to a point on said belt for driving said printhead with a reciprocal motion;

a counterbalance having a mass substantially equal o the mass of said printhead;

counterbalance guide means which constrains said counterbalance to move parallel to the motion of said printhead, said counterbalance guide means being secured to the base structure of said printer and extending through the loop of said endless belt; and counterbalance drive means coupling said counterbalance to said belt at a point halfway around said belt from the point coupling said belt to said printhead.

2. A reciprocating printhead shuttle as recited in claim 1 where the motion of said printhead is parallel to the run of said belt, and said means for driving said printhead comprises a printhead drive link rotatably coupled to said point on said belt and pivotably coupled to said printhead.

3. A reciprocating printhead shuttle as recited in claim 1 where said means for imparting continuous unidirectional motion to said belt comprises a constant speed motor coupled to one of said pulleys.

4. A reciprocating printhead shuttle as recited in claim 3 where the motion of said printhead is parallel to the run of said belt and said means for driving said printhead comprises a printhead drive link rotatably coupled to said point on said belt and pivotably coupled to said printhead.

5. A reciprocating printhead shuttle as recited in claim 1 where said means for driving said counterbalance comprises a counterbalance drive link rotatably coupled to said belt at a point halfway around said belt from the point coupling said belt to said printhead, and pivotably coupled to said counterbalance.

6. A reciprocating printhead shuttle as recited in claim 5 wherein said counterbalance has a cutout portion permitting said counterbalance drive link to pass through said counterbalance as the point of coupling of said counterbalance drive link to said belt traverses said pulleys.

* * * * *